United States Patent [19]

Anderson et al.

[11] Patent Number: 4,619,450

[45] Date of Patent: Oct. 28, 1986

[54] COPYING APPARATUS WITH AUTOMATIC BOTTOM FEEDER

[75] Inventors: Carl P. Anderson, Menlo Park; Edward F. Mayer, San Jose, both of Calif.

[73] Assignees: Ricoh Systems, Inc., San Jose, Calif.; Ricoh Company, Ltd., Tokyo, Japan

[21] Appl. No.: 732,608

[22] Filed: May 10, 1985

[51] Int. Cl.[4] ..... B65H 3/04

[52] U.S. Cl. ..... 271/35; 271/94; 271/161; 271/166

[58] Field of Search ..... 271/161, 166, 169, 94, 271/95, 99, 106, 35, 117, 118, 105

[56] References Cited

U.S. PATENT DOCUMENTS

| | | | |
|---|---|---|---|
| 2,227,643 | 1/1941 | Hageman | 271/161 X |
| 3,612,512 | 10/1971 | Lang | 271/35 |
| 4,336,929 | 6/1982 | Hanzlik | 271/35 X |

FOREIGN PATENT DOCUMENTS

| | | | |
|---|---|---|---|
| 553181 | 5/1977 | U.S.S.R. | 271/166 |

*Primary Examiner*—Richard A. Schacher
*Attorney, Agent, or Firm*—Flehr, Hohbach, Test, Albritton & Herbert

[57] ABSTRACT

A bottom feeder for copy paper feeding has means for imparting a curvature to the sheets, the curvature being in the direction the sheets will be withdrawn. The curvature provides transverse rigidity to permit lifting weight of stack off the bottom sheet. This facilitates withdrawing the sheets one at a time from the bottom of the stack.

A curved paper tray imparts a curvature to the paper. A pair of holding clamps are provided, one on either side of the stack of paper, which are partially withdrawn from the sides of the paper stack so that paper may be added to the stack. When sheets are to be fed, the clamps which comprise a pair of plates having a friction material on the paper facing side thereof are moved in to engage the sides of the stack of paper. An arrangement is provided to thereafter lower the paper tray slightly from the bottom of the stack, or lift the clamps and the curved paper stack. In either event, the pressure of the stack weight is now removed from the bottom sheet.

A vacuum type feed belt which passes under the stack of paper can now pick off one sheet at a time without the sheets being restrained by friction against the paper tray or created between the tray and the stack of paper.

The friction material on the holding plates in a preferred embodiment comprises bristles angled upward away from the paper tray to retain the stack lifted from the paper tray while allowing relatively easy withdrawal of each sheet. A stack-height sensor, preferably a switch on the face of one of the plates, senses the condition where, as the height of the stack diminishes, the pressure of the holding clamp plates may be slightly reduced to avoid binding of the paper. Timing means, which in the disclosed embodiment comprise cams riding on a common shaft, are provided to coordinate the movement of the clamps toward and away from the sides of the stack with the movement of the paper tray away from the bottom of the stack of paper.

21 Claims, 4 Drawing Figures

COPYING APPARATUS WITH AUTOMATIC BOTTOM FEEDER

Figure 1:
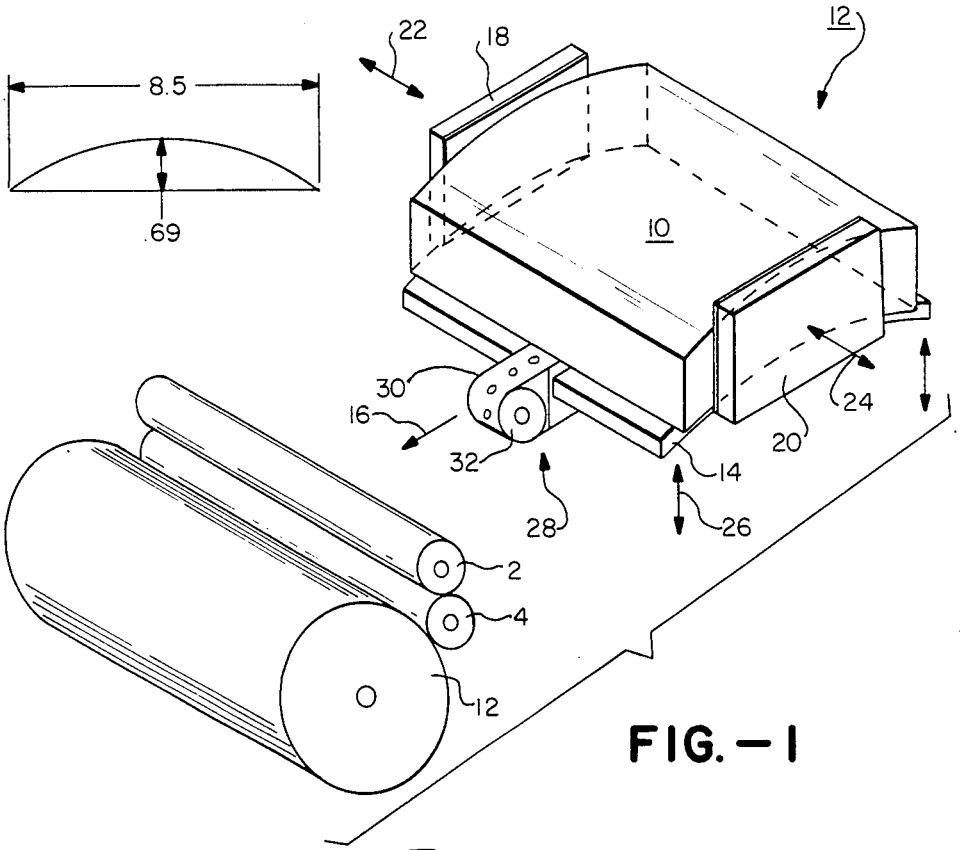

The present invention relates generally to electrophotographic copying apparatus and more particularly to one designed to make successive copies using an automatic arrangement for feeding successive sheets of paper taken from the bottom of the stack of paper.

It is highly desirable in today's high-speed, multicopy machines to provide a means in the copy machine for automatically feeding a very large stack of paper, sheet by sheet, into the machine. However, in top feeding type machines, it is difficult to provide for a tall stack of paper, because either the sheet feeding apparatus must follow the stack of paper down as it diminishes with successive sheets being fed, or alternatively, a means must be provided for detecting the level of paper in the paper tray and raising the top of the paper stack to within range of the sheet feeder.

Alternatively, in attempting to design a machine for feeding sheets off the bottom of a stack, means must be provided to allow for withdrawing a sheet from the bottom of the stack although the weight of the rest of the stack can be very large at the beginning, and may vary significantly over the course of a sheet-feeding sequence.

It is therefore an objective of the present invention to provide an improved bottom sheet feeder for feeding successive sheets from the bottom of a stack of paper.

Another objective of the present invention is to provide means for avoiding the problem of the significant pressure which may be applied to the bottom sheet of a stack of paper if a large stack of paper is in the tray.

Yet another objective of the present invention is to provide a copy paper automatic feed arrangement able to hold a large stack of paper.

A further objective of the present invention is to provide a copy sheet feed arrangement in which additional paper can be added to the top of the stack easily and quickly, while the device continues to operate and feed paper.

As discussed above, and as will be seen in the detailed description to follow, the paper feeding arrangement designed in accordance with the present invention is especially for use in an electrophotographic apparatus designed to make successive copies by using a continuous copy paper feeding arrangement. The arrangement is configured to act on the stack of paper in a way which successively draws successive sheets of paper from the bottom of the stack into the copying machine. A typical copying machine with which this apparatus is especially useful is disclosed in U.S. Pat. No. 4,382,784, assigned to the Assignee of the present invention incorporated herein by reference.

The bottom feeder for copy paper feeding of the present invention specifically comprises means for imparting a curvature to the sheets, the curvature being in the direction in which sheets will be withdrawn. The curvature provides transverse rigidity to permit lifting weight of stack off the bottom sheet. This facilitates withdrawing the sheets one at a time from the bottom of the stack. The relationship between the curvature of the stack and the lifting pads is essential. This system works with the paper curved in an arc perpendicular to the force of the pads on the sides. This creates a rigidity in the stack to oppose the pressure of the pads and allows the stack to be supported by the pads. This permits either the stack to be lifted by the pads or, conversely, the bottom support to be dropped and the bottom sheet withdrawn easily. Without this curvature, when pressure is applied by the pads, the paper would not resist or bend in the direction of the force and lifting would merely raise the edges closest to the pads and allow the entire weight of the stack to trap the bottom sheet.

The embodiment disclosed herein provides a curved paper tray to impart a curvature to the paper. A pair of holding clamps are provided, one on either side of the stack of paper, which are partially withdrawn from the sides of the paper stack so that paper may be added to the stack. When sheets are to be fed, the clamps which comprise a pair of plates having a friction material on the paper facing side thereof are moved in to engage the sides of the stack of paper. An arrangement is provided to thereafter lower the paper tray slightly from the bottom of the stack, or lift the clamps and the curved paper stack. In either event, the pressure of the stack weight is now removed from the bottom sheet of paper.

The paper feed arrangement, preferably a vacuum type feed belt which passes under the stack of paper, can pick off one sheet at a time without the sheets being restrained by friction against the paper tray or created between the tray and the stack.

Several optional features add to the utility of the present invention. The friction material on the holding plates in a preferred embodiment comprises bristles angled upward away from the paper tray to retain the stack lifted from the paper tray while allowing relatively easy withdrawal of each sheet. A stack-height sensor may be provided, preferably a switch on the face of one of the plates, so that as the height of the stack diminishes, the pressure of the holding clamp plates may be slightly reduced to avoid binding of the paper. Timing means, which in the disclosed embodiment comprise cams riding on a common shaft, are provided to coordinate the movement of the clamps toward and away from the sides of the stack with the movement of the paper tray away from the bottom of the stack of paper.

Figure 2:
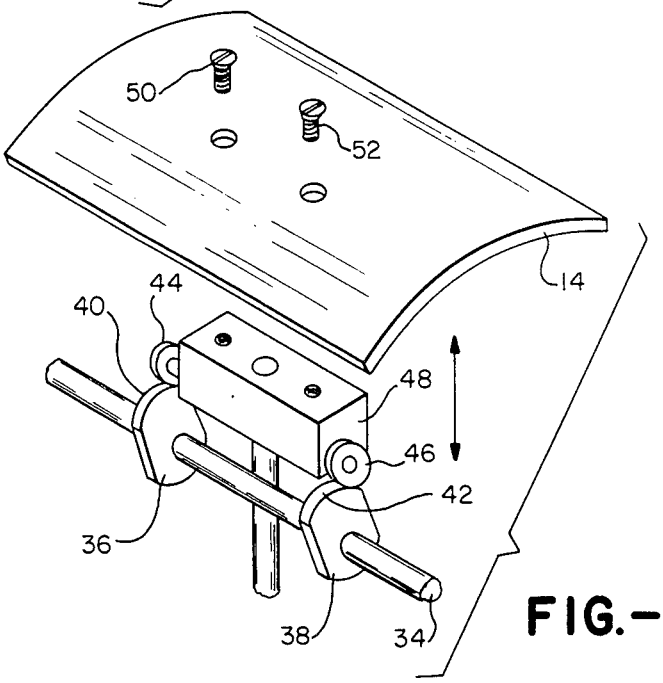
Figures 3, 4:
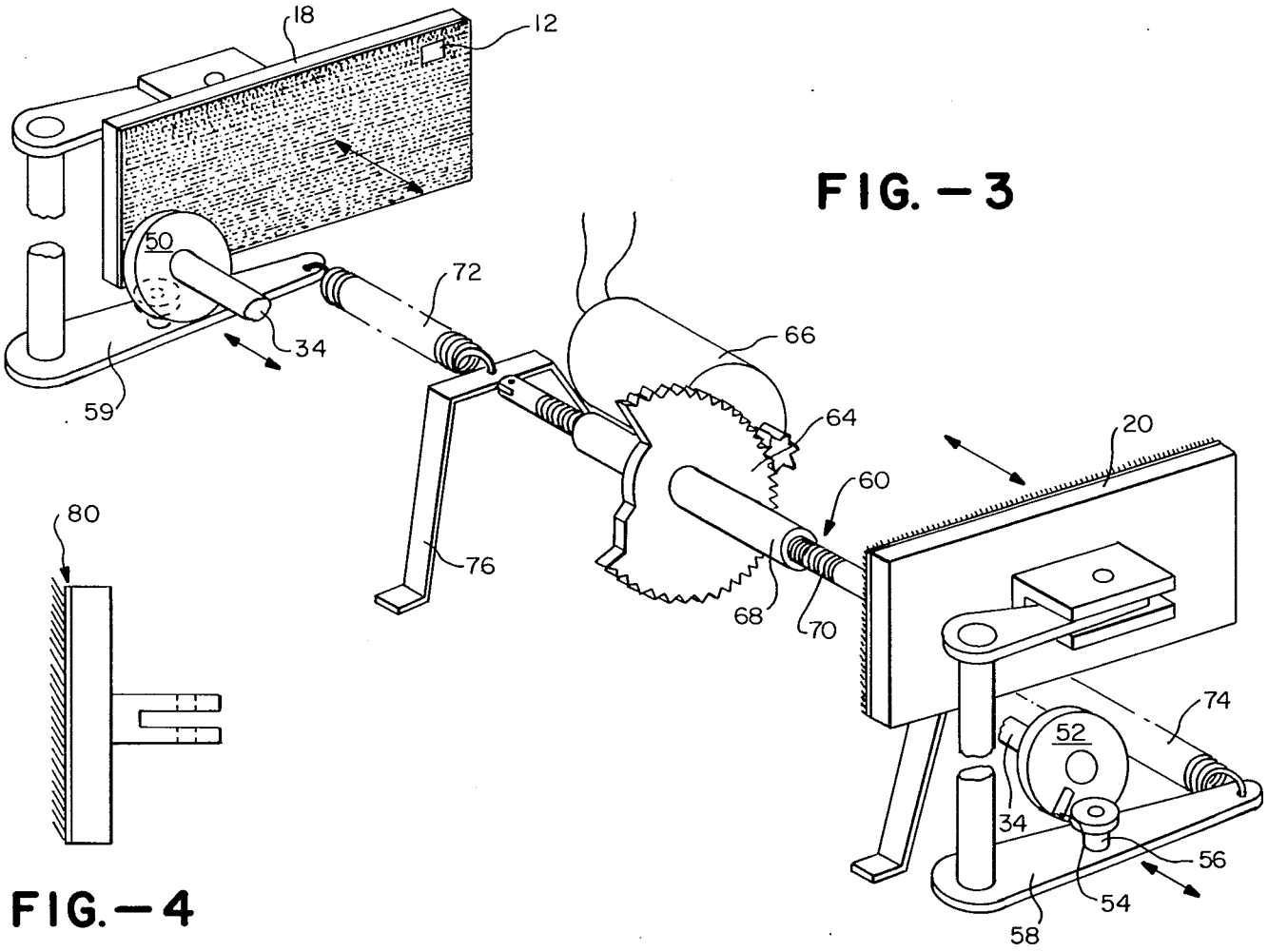

In this way, when the paper tray is in its upper, or paper-supporting position, the holding clamps or plates are withdrawn from the sides of the stack of sheets; movement of the clamps against the paper stack precedes withdrawal of the paper tray. The overall bottom sheet feeding assembly will be described in more detail hereafter in conjunction with the drawings wherein:

FIG. 1 is a perspective view of the bottom sheet feeding arrangement showing the relative position and path of movement of the major elements;

FIG. 2 comprises an exploded perspective view of the means for raising and lowering the stacking tray relative to the stack of copy paper;

FIG. 3 is an exploded perspective view of the major elements used to adjust the position of the holding clamps relative to the stack of paper, as well as to time the movements of the holding clamps relative to the movement of the stacking tray; and FIG. 4 is a detailed view of one of the side plates which function as a holding clamp means showing especially the bristling material which is used to retain the stack of sheets in an easily fed configuration.

Turning to these drawings, wherein like components are designated by like reference numerals throughout the first various figures, the left-hand side of FIG. 1 shows a pair of feed rollers 2, 4 which are used to feed individual sheets drawn from the bottom of the stack of paper 10 across the surface of a transfer roller 12 which is a known part of an overall electrophotographic copying apparatus. While not shown, this apparatus includes the necessary components for making copies from original documents. These components include, for example, a rotatable drum having a photosensitvie outer circumferential surface, means for forming an electro-photostatic image corresponding to the original being copied on the drum's photosensitive surface, means for developing the image forms using suitable toner, and means for transferring the applied toner from the drum to a blank sheet which ultimately becomes the final copy. For a more detailed discussion of some of these components, reference is made to the issued U.S. Patent which is incorporated by reference above.

In addition to the components referred to above, the copying apparatus includes the automatic bottom sheet feeding arrangement indicated generally at 12. It should first be noted that the tray on which the paper rests comprises a curved tray 14. The tray has a curvature in the preferred embodiment which will give a total curvature of about 0.69" at its highest point to paper of 8.5" width as shown in the upper left of FIG. 1. This calculates to a radius of the circle of approximately 13.4" in the preferred embodiment. It has been found by experiment that having the curvature in the direction of feed as shown by the arrow 16 in FIG. 1 maximizes the ease with which the paper can be withdrawn.

This curvature forms the paper into a stack easily supported from the sides, thereby aiding the holding clamps 18, 20 in supporting the paper from the sides. When the clamps are supporting the paper, either the stack may be raised off the paper tray or the paper tray moved away from the stack. In either event, distancing the curved stack from the tray substantially unweights the bottom sheet, allowing it to be easily withdrawn.

As indicated by the arrows 22, 24, these two clamps move toward and away from the paper stack 10 in a timed relationship with the movement of the tray 14 in the direction of the arrow 26.

Specifically, the tray 14 is initially raised to its upper position and the holding clamps 18 and 20 moved away from the side of the paper stack. It is at this point in the cycle that paper may be added to the stack. The clamps are next moved back against the sides of the stack, and then the curved tray 14 is withdrawn about 0.03", a sufficient distance to remove the weight of the stack of the bottom sheets from the tray. The stack of sheets is now held in place by the side holding clamps. The vacuum pick-off 28 which comprises a vacuum belt 30 rotating around a roller 32 and passing approximately over the surface of the curved tray can now withdraw one sheet at a time from the bottom of the stack.

The movement of the tray 14 up and down is achieved using a straight-forward mechanical arrangement which is illustrated in FIG. 2 and comprises a cyclic cam shaft 34 carrying cams 36, 38 which are shown in the upward position so that the extended surfaces 40, 42 of these cams rest against the wheels 44, 46 of the drive block 48. This block 48 in turn is attached to the bottom of the curved paper tray 14 by screws 50, 52. Thus, each time a sheet is to be withdrawn, the cyclic cam shaft 34 rotates the high sides 40, 42 away from the drive block 48, so that the sheet-carrying tray sinks slightly away from the bottom of the stack leaving a sufficient opening for the vacuum belt or other sheet removal means to remove the bottom sheet from the tray.

Referring to FIG. 3, it can be seen that this same shaft 34 carries on its ends a pair of wheels 50, 52, each of which has a lobe 54 which periodically passes an arm 56 extending up from a lever 58 which is connected in turn to one of the holding clamps. Thus, with each rotation of the shaft, the lobe 54 which is carried on each wheel periodically moves the holding clamps 18, 20 away from the sides of the stacks so the paper again may settle onto the top of the tray 14; after the lobe passes the arm 56, the holding clamps 18, 20 again rest against the sides of the stack and hold it in place while the curved tray moves away from the bottom of the stack so that the bottom sheet can easily be removed.

A second shaft 60 is provided to periodically reduce the pressure against the sides of the stack to take into account the reduced height of the stack. By providing an encoder on the shaft 34, or a switch 62 on the side of the bin, it is possible to physically sense the lower stack height in the copy feed sheet bin. It may then be necessary to reduce the clamping pressure of the holding clamps 18, 20 against the sides of the stack. This is achieved by providing a gear 64 driven by a motor 66 which, through a turnbuckle 68 turns a screw 70 which, through the arms 72, 74, pulls the levers 58, 59 slightly together, thereby spreading the holding clamps 18, 20 slightly away from the sides of the paper and reducing the pressure thereon. An antirotation element 76 prevents rotation of this shaft and provides only for lateral motion conveyed by the arms 72, 74 to the clamp supports which include the levers 58, 59.

As discussed above, the clamp on either side of the paper stack comprises a flat metal plate to which friction material is attached. The friction material in contact with the sides of the paper is preferably a bristle mat indicated generally in FIG. 4 as being 2.25 mm thick. The bristles are not perpendicular to the mat's surface but are at an approximate angle of 60° from perpendicular to the plate surface. When mounted in the feeder, the bristles are oriented to point up, thus resisting the natural tendency of the paper stack to move downward.

It has further been found that for a stack of 1,000 sheets, which this device may well be capable of holding, the clamps must press against the stack with a force of approximately 1.587 kg. Holding the stack in this position after lowering the curved tray requires roughly 15 g to extract the bottom sheet, which is a relatively low force level and demonstrates the effectiveness of this system in providing a bottom sheet feeder.

It has further been found that as the area of contact between the paper stack and the holding clamps decreases from the maximum as the paper was withdrawn sheet by sheet, the unit pressure increases. This in turn increases the force required for withdrawing the bottom sheet. Also, as the paper supply drops to a few sheets, the pressure would decrease to near zero. The foregoing has resulted in the addition of motorized turnbuckle described above for adjusting the length of the clamp pressure springs. Electronic control of the motor and stack height sensing, provide for the necessary pressure adjustments to maximize the ability of successively withdraw sheets for feeding.

Other embodiments of the present invention than the above disclosed preferred embodiment may become apparent to a person of skill in the art who studies this invention disclosure. Therefore, the scope of the present invention is to be limited only by the following claims.

What is claimed is:

1. In an electrophotographic apparatus designed to make successive copies utilizing a stack of copy paper utilizing a feeding arrangement configured to act on the stack in a way which successively moves pieces of paper off the bottom of the stack when the latter is placed in a feed tray, the paper feed assembly comprising means for imparting a curvature to the stack of paper, a pair of holding clamps arranged on either side of the feed tray facing the feed tray to hold said stack of copy paper in its curved position, said holding claims comprising a pair of plates, one on each side of said paper stack, said plates being movable into and out of engagement with the sides of said paper stack to hold said stack of copy paper in its curved position.

means for causing relative movement between the copy paper stack and the feed tray to allow withdrawal of the bottom sheet of copy paper, and means for withdrawing the bottom sheet of copy paper while the feed tray is at a distance from the paper stack.

2. An apparatus as claimed in claim 1 wherein said feed tray is curved, the radius of curvature being in the direction of paper feed, to impart a corresponding curvature to the stack of paper.

3. An apparatus as claimed in claim 2 further comprising timing means for timing paper withdrawal including holding a curved tray comprising the feed tray in a first position wherein said copy may be loaded in said stack, means for moving the tray away from the paper stack and moving the holding clamps against the curved paper stack so that a sheet or sheets of paper may be removed.

4. An apparatus as claimed in claim 1 wherein said means for withdrawing the bottom sheet comprises a vacuum belt passing the bottom of the paper stack and along the top of the feed tray.

5. An apparatus as claimed in claim 1 further comprising friction material on a paper confronting surface of each of said plates for engaging the edges of the stack of copy paper.

6. An apparatus as claimed in claim 5 further comprising means for imposing a curvature on the stack of paper, the radius of curvature being in the direction of withdrawal of the paper.

7. An apparatus as claimed in claim 6 wherein said means for imposing said curvature comprises a curved plate arranged to function as the feed tray.

8. An apparatus as claimed in claim 5 wherein said friction material comprises a bristle mat, the bristles being directed substantially toward the edges of the paper stack.

9. An apparatus as claimed in claim 8 wherein the friction material comprises bristles oriented at an angle of about 60° from the confronting plates, the bristles being angled up relative to the feed tray to support the paper.

10. An apparatus as claimed in claim 1 further comprising means cooperating with the holding plates for controlling the pressure of the holding clamps against the paper stack of the feed tray comprising means for monitoring the height of the stack and means responsive to the monitoring means for reducing the pressure of the holding clamps against the sides of the paper stack.

11. An apparatus as claimed in claim 10 wherein said holding clamps comprise a pair of plates facing the sides of said stack of paper, said pressure control means comprising a shaft extending between and coupled to said plates, said shaft incorporating a gear and screw for modifying the length of said shaft, and a motor responsive to said stack height sensor to rotate said gear and said screw modifying the length of said shaft and thereby the stack support distance between the plates.

12. An apparatus as claimed in claim 3 wherein said timing means further comprise a control shaft carrying first and second cams, said first cam being positioned and shaped to engage said feed tray and raise it to a paper feed stack loading position, a second cam being positioned to move said holding clamps to a position away from the paper stack, so that paper may be added to the stack.

13. In an electrophotographic apparatus designed to make successive copies utilizing a stack of copy paper by utilizing a feeding arrangement configured to act on the stack in a way which successively moves pieces of paper off the bottom of the stack when the latter is placed in a feed tray, said feed tray including means for creating curvature in the stack in the direction of paper withdrawal, the paper feed assembly comprising a pair of holding clamps arranged on either side of the feed tray facing the feed tray, means for moving the holding clamps laterally relative to the paper stack on the feed tray, means for moving the paper tray toward and away from the paper stack, means for withdrawing the bottom sheet of copy paper while the feed tray is at a distance from the paper stack, and timing means for coordinating the movement of said clamp moving means, said tray moving means and said paper withdrawing means.

14. An apparatus as claimed in claim 13 wherein the paper tray is curved, the radius of curvature being in the direction of paper feed, to impart a corresponding curvature to the stack of paper.

15. An apparatus as claimed in claim 14 wherein said holding clamps comprise a pair of plates, one on each side of said paper stack, movable into and out of engagement with the paper stack.

16. An apparatus as claimed in claim 15 further comprising friction material on a paper confronting surface of each of said plates for engaging the edges of the stack of copy paper.

17. An apparatus as claimed in claim 16 wherein the friction material comprises bristles oriented at an angle of about 60° from the confronting plates, the bristles being angled up relative to the feed tray to support the paper.

18. An apparatus as claimed in claim 17 wherein said timing means further comprise a control shaft carrying first and second cams, said first cam being positioned and shaped to engage said feed tray and raise it to a paper feed stack loading position, a second cam being positioned to move said holding clamps to a position away from the paper stack, so that paper may be added to the stack.

19. An apparatus as claimed in claim 18 further comprising means cooperating with the holding plates for controlling the pressure of the holding clamps against the paper stack of the feed tray comprising means for monitoring the height of the stack and means responsive to the monitoring means for reducing the pressure of the holding clamps against the sides of the paper stack.

20. An apparatus as claimed in claim 19 wherein said holding clamps comprise a pair of plates facing the sides of said stack of paper, said pressure control means comprising a shaft extending between and coupled to said plates, said shaft incorporating a gear and screw for modifying the length of said shaft, and a motor responsive to said stack height sensor to rotate said gear and said screw modifying the length of said shaft and thereby the stack support distance between the plates.

21. An apparatus as claimed in claim 16 wherein said timing means further comprise a control shaft carrying first and second cams, said first cam being positioned and shaped to engage said feed tray and raise it to a paper feed stack loading position, a second cam being positioned to move said holding clamps to a position away from the paper stack, so that paper may be added to the stack.

* * * * *